United States Patent [19]

Rudell et al.

[11] 4,390,178

[45] Jun. 28, 1983

[54] PIVOTAL JUMPING STICK

[75] Inventors: Elliot Rudell, 5319 W. 146th St., Lawndale, Calif. 90260; Joseph Cernansky; Harold Garner, both of Los Angeles County, Calif.

[73] Assignee: Elliot Rudell, Lawndale, Calif.

[21] Appl. No.: 381,838

[22] Filed: May 25, 1982

Related U.S. Application Data

[63] Continuation of Ser. No. 161,265, Jun. 20, 1980, abandoned.

[51] Int. Cl.[3] ..... A63B 25/08

[52] U.S. Cl. ..... 272/114

[58] Field of Search ..... 272/70, 70.1, 114; 135/65, 67, 71–73; 3/4; 36/7.8

[56] References Cited

U.S. PATENT DOCUMENTS

| | | | |
|---|---|---|---|
| 3,102,272 | 9/1963 | Emmert | 3/4 |
| 3,205,596 | 9/1965 | Hoffmeister | 272/70 X |
| 3,371,927 | 3/1968 | Ryan et al. | 272/114 |
| 3,902,199 | 9/1975 | Emmert | 3/4 |
| 4,243,218 | 1/1981 | DeSousa | 272/114 |

FOREIGN PATENT DOCUMENTS

| | | | |
|---|---|---|---|
| 1028416 | 2/1953 | France | 272/114 |

*Primary Examiner*—Richard C. Pinkham
*Assistant Examiner*—S. R. Crow
*Attorney, Agent, or Firm*—Michael D. Scott

[57] ABSTRACT

A pivotal jumping stick with the handlebars and footrest connected together and pivoted at their centers to permit the user to maintain his balance on uneven terrain. While in motion, a pin slides vertically in a slot formed in the impacting rod, counteracting the inherent twisting force of the spring mechanism, and allowing the user to accurately steer the device.

4 Claims, 9 Drawing Figures

FIG. 6.
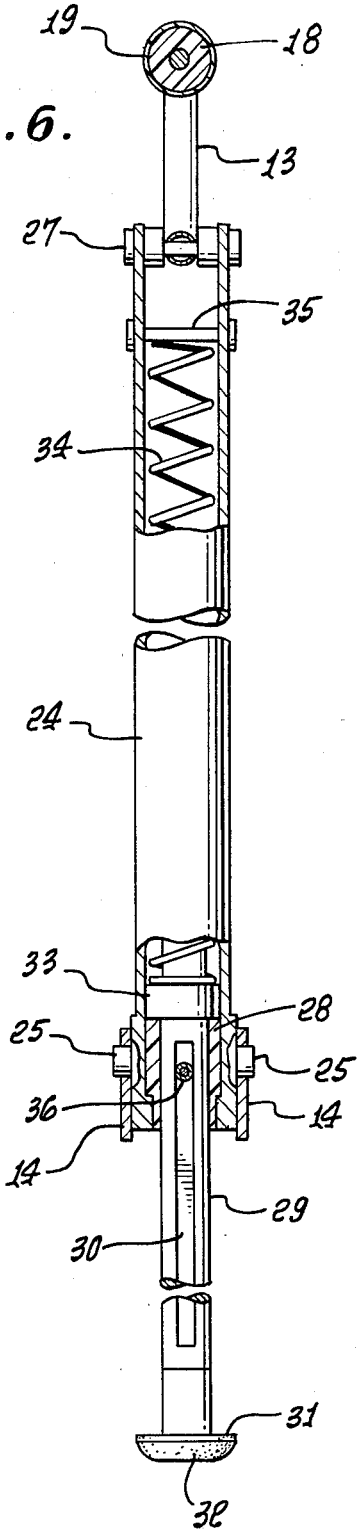
FIG. 7.
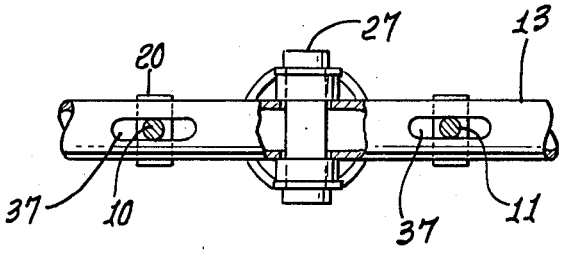
FIG. 8.
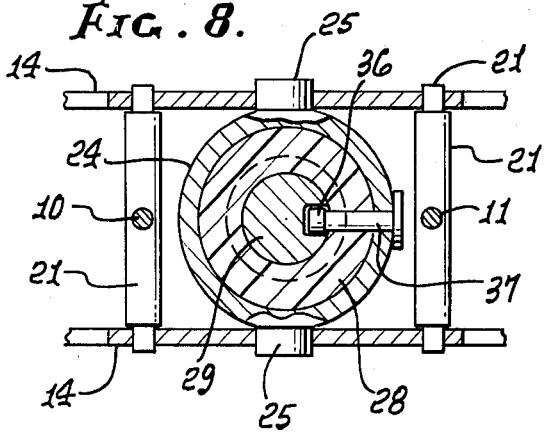
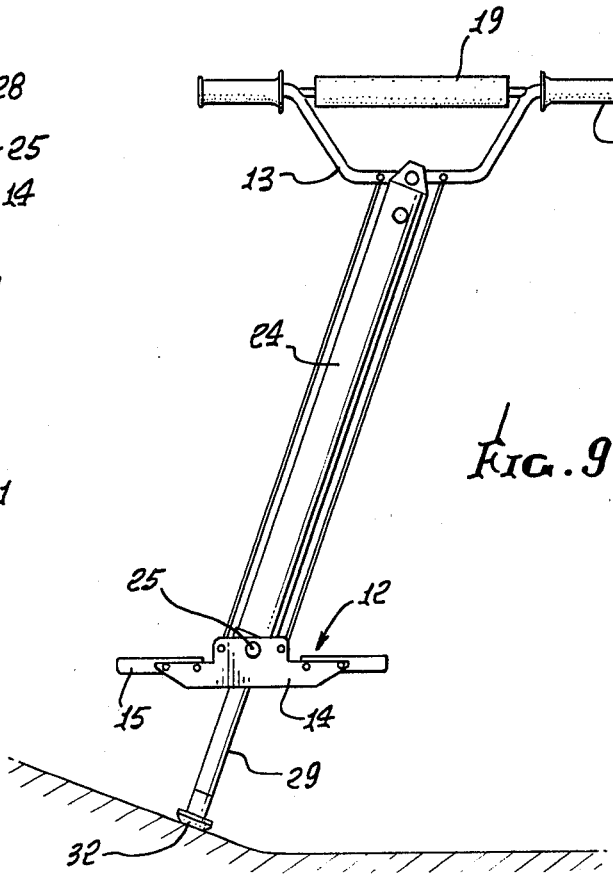
FIG. 9.

PIVOTAL JUMPING STICK

This application is a continuation of application Ser. No. 6/161,265, filed June 20, 1980 now abandoned.

Cross-references to related applications, if any:

Design patent application on invention filed Sept. 14, 1979; Ser. No. 6/075,848.

BRIEF SUMMARY OF THE INVENTION

The invention relates to improvements in pivotal jumping stick, and is primarily concerned with a new and improved pivotal jumping stick that is constructed in such a manner as to be safe and durable, and that can be used in competitive situations.

The principal object of the invention is to provide a new and improved pivotal jumping stick that can be steered and used on uneven terrain. The present invention differs from the many conventional pivotal jumping sticks and jumping toys hitherto devised in the following particulars:

1. The handlebars and footrest are connected together, and pivoted at their centers, to permit the user to maintain his balance on uneven terrain; and 2. While in motion, a pin slides vertically in a slot formed in the impact rod, counteracting the inherent twisting force of the spring mechanism, and allowing the user to accurately steer the device.

Another object of this invention is to provide a pivotal jumping stick of improved safety for children. Prior pivotal jumping sticks were only usable in a near-vertical orientation; if, for any reason, the stick struck the ground in other than a near-vertical orientation, the user would be propelled horizontally off of the stick, with the possibility of injury. The invention herein is much less subject to such action, since the pivoting handlebars and footrests assist the user in maintaining his balance, even on uneven terrain, thereby lessening the possibility of being propelled off the stick.

By eliminating the constant rotation inherent in the prior art, the invention permits the user to steer the stick in a predetermined direction. This also provides additional safety for the user, since he will not unexpectedly be propelled into the street, stationary object or other person, with the possibility of injury.

BRIEF DESCRIPTION OF THE DRAWINGS

FIG. 6 is a side view of the preferred embodiment in FIG. 4 with cutaway, looking in the direction of arrow 6;

FIG. 7 is a bottom view of the preferred embodiment in FIG. 4, looking in the direction of arrow 7;

FIG. 8 is a top view of the preferred embodiment in FIG. 4, looking in the direction of arrow 8; and FIG. 9 is a front view of the preferred embodiment of FIG. 4, showing how the invention would look when in use on a non-horizontal surface.

DETAILED DESCRIPTION

Figure 1:
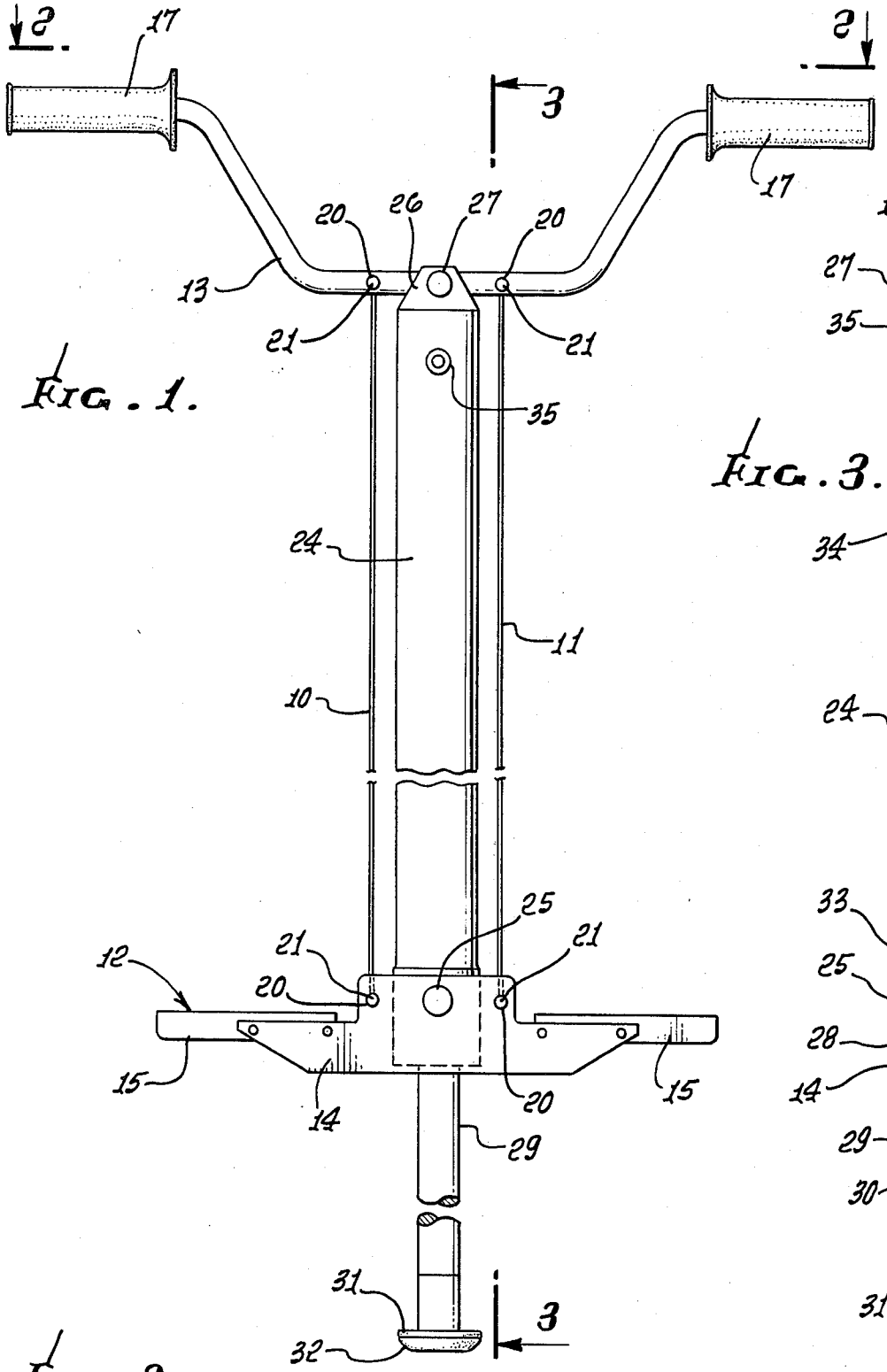
FIG. 1 is a front view of the pivotal jumping stick.

The improved pivotal jumping stick comprises pivoting means consisting of a parallelogram configuration formed from two parallel vertical rods (10 and 11) of a suitably rigid material, such as steel, and two horizontal members (12) and (13). The lower horizontal member is a foot means (12) formed from a length of suitably rigid material, preferably cast or stamped steel, which has a center portion consisting of two parallel plates (14) with a lateral extension on each side (15) on which the feet of the user rest when the device is in use, the top side of each lateral extension being preferably covered with a resilient, high friction material, such as rubber formed with a "knobby" tread design (16) to both cushion the feet of the user and prevent the user's feet from accidentally coming off the foot means while the device is in use.

The upper horizontal member is a handle means (13) formed of a length of suitably rigid material, preferably steel, configured in an elongated "U"-shape as shown in FIG. 1, the ends of said handle means being provided with cushioned hand grips (17). In the preferred embodiment a cross-bar of suitably rigid material (18), such as steel, is affixed to the upper end of said handle means in any convenient manner, such as by welding, the center portion of such cross-bar preferably encased in sponge rubber or other suitable cushioning material (19). The vertical rods (11) are connected to the foot means (12) and handle means (13) at four pivot points (20), by pins (21) which pass through and rotate within oppositely aligned, traverse openings in the handle means and the foot means, which together form the pivoting means. The vertical rods (11) enter the handle means (13) through elliptical slots 37, as shown in FIG. 7. While two rods are illustrated in the drawings, it should be noted that one rod could be used with equal force and effect to insure simultaneous movement of foot means and handle means.

The exterior tube (24) is formed of any suitably rigid, tubular material, preferably steel, the lower end of which is secured to the foot means (12) by pins (25) affixed to the tube, which pass through and rotate within oppositely aligned, traverse openings in the center of the footrest; the upper end of which is formed into a handle pivot (26). The handle means (13) are connected to the exterior tube (24) by means of a pin (27) which passes through the center of the handle means and passes through and rotates within centered, oppositely aligned openings in the handle pivot.

Affixed to the lower, inside surface of the exterior tube (24) is a band of suitably low friction material which requires no lubrication, such as Teflon, polyethylene or nylon (28). Fitted within the bottom portion of the exterior tube (24) is the impacting means (29), formed of a length of suitably rigid material, preferably steel, and containing a bearing groove (30). Affixed to the bottom of the impacting means, by any suitably means, is a rigid disc, preferably of steel (31) of a diameter larger than the main rod, the bottom of which is preferably covered by a resilient, long-wearing, high-friction material, such as rubber (32), to prevent damage to the rod and to provide traction. The impacting means is of such a diameter as to fit smoothly within the band (28), and permit the impacting means to slide freely within the exterior tube (24). Securely affixed to the impacting means above the band, such as by welding, is a collar (33), of suitably rigid material.

Figure 3:
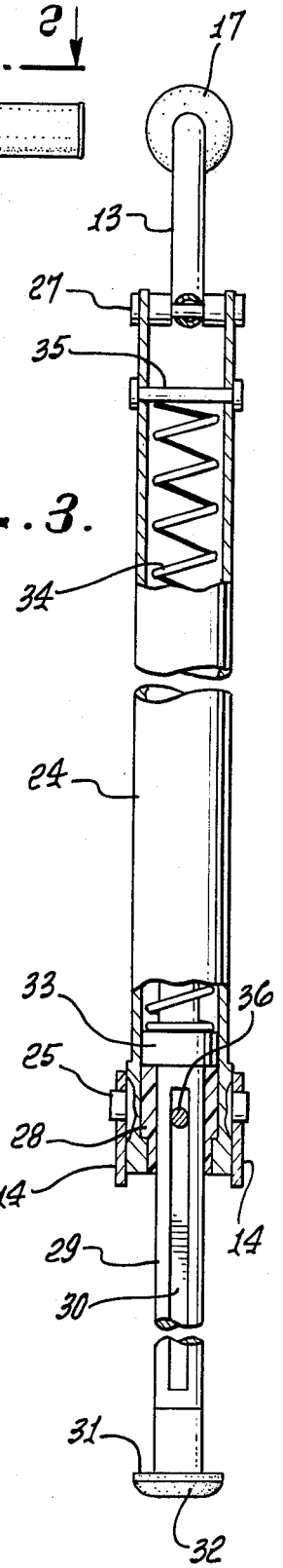
FIG. 3 is a side view with cutaway, looking in the direction of arrow 3.
Figure 2:
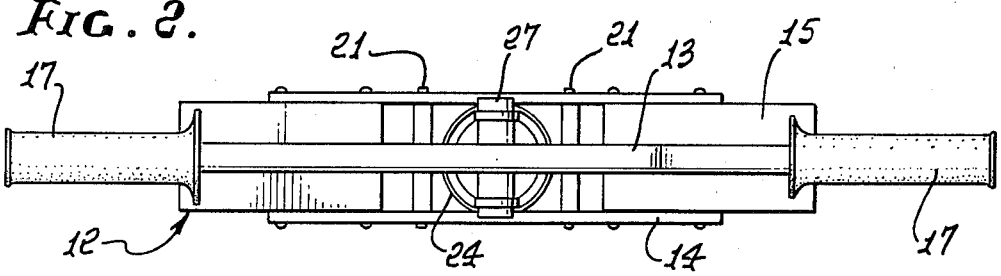
FIG. 2 is a top view thereof, looking in the direction of arrow 2.
Figure 4:
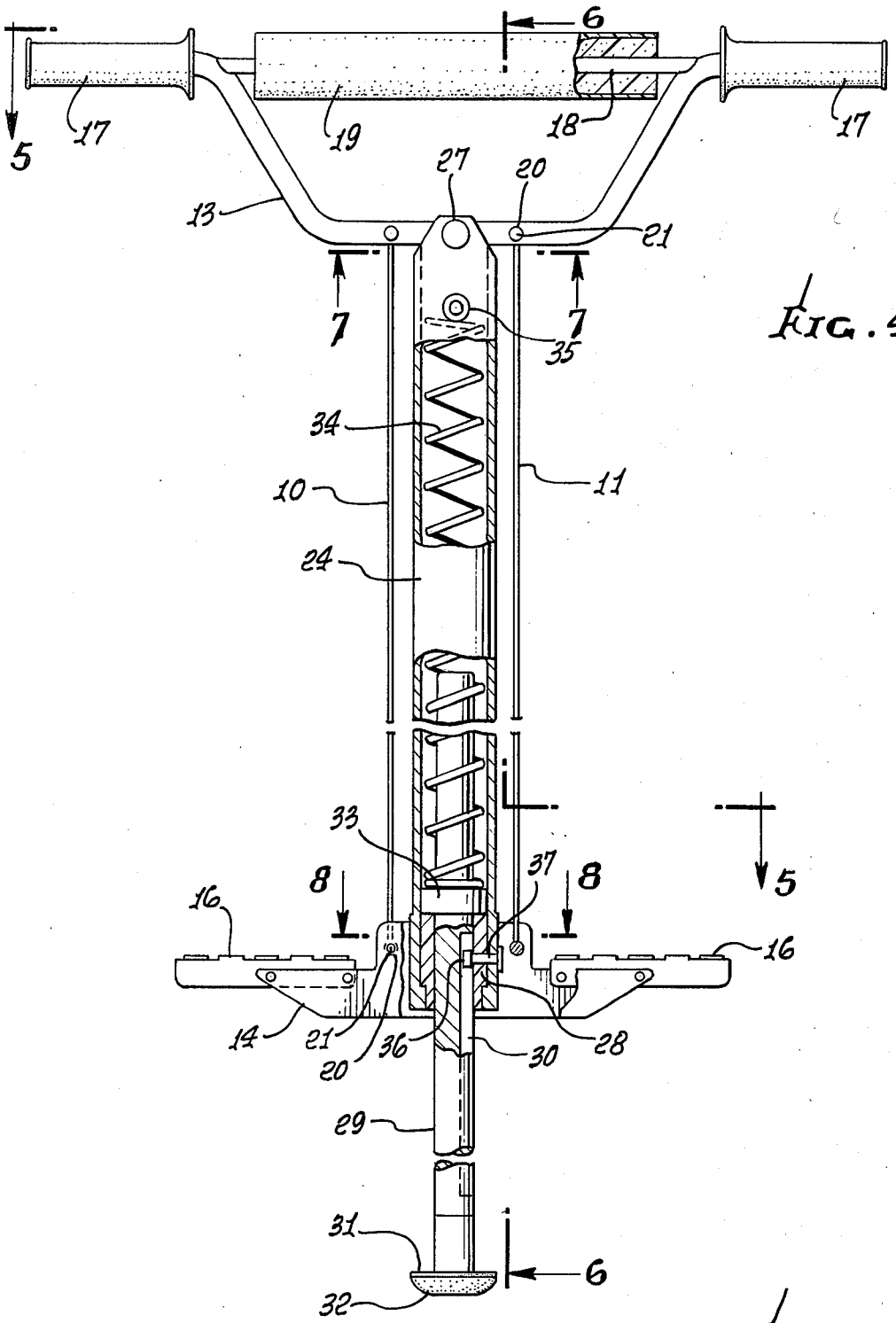
FIG. 4 is a front view thereof, with cutaway, showing the preferred embodiment thereof.
Figure 5:
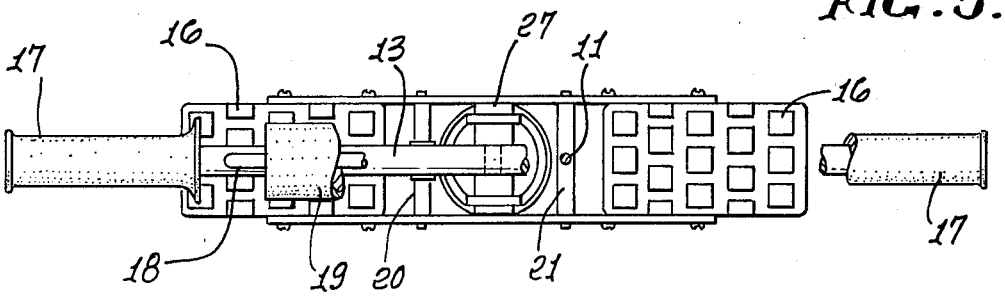
FIG. 5 is a top view of the preferred embodiment in FIG. 4 with cutaway, looking in the direction of arrow 5.

A coil spring (34) is contained within the exterior tube (24), supported between the collar (33) and a pin (35) which pass through oppositely aligned, transverse openings in the exterior tube. As best seen in FIGS. 3 and 4, the spring (34) bears against the collar (33), but the collar is prevented from moving downward beyond the end of the exterior tube by virtue of the band (28). A roller bearing (36) of suitably rigid material, preferably steel, rides within the bearing groove (30), and is securely connected to the exterior tube (24) by means of a pin (37) which is affixed to the exterior tube.

In operation, the user rests his feet on the foot means (14), places his hands on the handle means (13) and bounces up and down as on pivotal jumping sticks old in the art. However, unlike the prior art, the invention permits the user to select the direction of travel of the device in a precise manner, and to use the device on uneven surfaces, hills, rough terrain, and even on stairs. As illustrated in FIG. 9, the invention is so constructed that on a non-flat surface the handle means and foot means can be controlled to remain perpendicular to a line running through the center of the earth. As a result, the center of gravity of the user-invention combination remains directly over the point at which the impacting means (31) touches the ground, thereby permitting the user to retain his balance on whatever surface the device is used. Additionally, the roller bearing (36) traveling in the bearing groove (30) counteracts the rotational forces normally created by the compression and expansion of the coil spring (34). Whereas previous pivotal jumping sticks were constantly rotating while in use, thereby preventing the user from choosing the precise direction of travel of the device while in use, the invention does not experience this rotation, and the user can accurately move the device in any chosen direction.

It will be understood that various changes and modifications may be made from the foregoing without departing from the spirit and scope of the appended claims.

We claim:

1. A jumping stick mechanism for use by a rider, including an exterior tube having an upper end and a lower end, foot means connected to the lower end of said exterior tube, impacting means slidably mounted within said exterior tube and projecting from said lower end adjacent to said foot means, spring means within said exterior tube abutting said impacting means, and handle means comprising handlebars attached to the upper end of said tube, and wherein the improvements comprise:

said foot means being pivotably mounted to said exterior tube whereby the rider can alter the angle of incidence of said foot means to said exterior tube in order to facilitate the rider shifting his body weight and position to achieve a different center of gravity to maintain balance and control of the jumping stick on uneven terrain, said handle means being pivotably mounted to said exterior tube whereby the rider can alter the angle of incidence of said handle means to said exterior tube in order to facilitate the rider shifting his body weight and position to achieve a different center of gravity to maintain balance and control of the jumping stick on uneven terrain.

2. The invention set forth in claim 1 and including: connecting means comprising one or more longitudinal rods that are rotatably connected to said handle means and foot means to maintain a constant relationship between said handle means and foot means, thereby achieving a parallelogram effect between said handle means and foot means, thus permitting the rider to predictably control the effect of his body lean and weight position change by coordinating the simultaneous pivoting attitude of both the handle means and foot means to achieve and maintain balance on uneven terrain.

3. The invention set forth in claim 1 and including: track means consisting of a vertical slot in the impacting means provided with a pin housed in said exterior tube and projecting into said slot slidable in said slot whereby torque from said spring means is eliminated.

4. A jumping stick mechanism for use by a rider, including an exterior tube having an upper and a lower end, foot means connected to the lower end of said exterior tube, impacting means slidably mounted within said exterior tube and projecting from said lower end adjacent to said foot means, spring means within said exterior tube abutting said impacting means, and handle means comprising handlebars attached to the upper end of said tube, and wherein the improvements comprise:

said foot means being pivotably mounted to said exterior tube whereby the rider can alter the angle of incidence of said foot means to said exterior tube in order to facilitate the rider shifting his body weight and position to achieve a different center of gravity to maintain balance and control of the jumping stick on uneven terrain, said handle means being pivotably mounted to said exterior tube whereby the rider can alter the angle of incidence of said handle means to said exterior tube in order to facilitate the rider shifting his body weight and position to achieve a different center of gravity to maintain balance and control of the jumping stick on uneven terrain, connecting means comprising one or more longitudinal rods that are rotatably connected to said handle means and foot means to maintain a constant relationship between said handle means and foot means, thereby achieving a parallelogram effect between said handle means and foot means, thus permitting the rider to predictably control the effect of his body lean and weight position change by coordinating the simultaneous pivoting attitude of both the handle means and foot means to achieve and maintain balance on uneven terrain, track means consisting of a vertical slot in the impacting means provided with a pin housed in said exterior tube and projecting into said slot slidable in said slot whereby torque from said spring means is eliminated.

* * * * *